United States Patent [19]

Nakada

[11] 4,205,305

[45] May 27, 1980

[54] BURGLAR ALARM

[76] Inventor: Tatsuji Nakada, 2, 35, 5-Chome, Tachibana, Sumida-ku, Tokyo, Japan

[21] Appl. No.: 908,837

[22] Filed: May 23, 1978

[51] Int. Cl.[2] ..... G08B 13/08; G08B 13/12

[52] U.S. Cl. ..... 340/548; 340/541; 340/545; 340/546; 116/81; 116/86; 116/94; 200/61.53; 200/61.76; 200/61.77; 200/61.79

[58] Field of Search ..... 340/548, 540, 541, 545, 340/546, 547; 116/67 R, 67 A, 75, 77, 81, 86, 94; 200/61.43, 61.5, 61.53, 61.71, 61.72, 61.74, 61.75, 61.76, 61.77, 61.79, 61.8, 61.84

[56] References Cited

U.S. PATENT DOCUMENTS

| | | | |
|---|---|---|---|
| 1,115,738 | 11/1914 | Randenburg | 340/546 |
| 2,201,972 | 5/1940 | Montray et al. | 200/61.79 |
| 2,274,870 | 3/1942 | Richards | 340/546 |
| 2,391,231 | 12/1945 | Edwards | 200/61.77 |
| 3,701,140 | 10/1972 | Dixon | 340/571 |
| 3,768,086 | 10/1973 | Powell et al. | 340/546 |
| 4,067,289 | 1/1978 | Joyner | 116/77 |
| 4,124,847 | 11/1978 | Cashman | 200/61.77 |

*Primary Examiner*—John W. Caldwell, Sr.
*Assistant Examiner*—Donnie L. Crosland
*Attorney, Agent, or Firm*—Staas & Halsey

[57] ABSTRACT

A burglar alarm provided with a housing which contains a bell assembly and a battery compartment connected in series with a switch assembly having a linearly movable element which can be displaced a predetermined threshold distance by a chain extending to a magnet temporarily joined to a metal bracket attached to a movable surface. The switch assembly contains a pivoted contact which moves against a fixed contact when the linearly movable element is displaced a predetermined distance, and remains there regardless of the subsequent position of the linearly moveable element until a button operationally connected to the switch assembly is moved to the "off" position. The bell assembly includes a motor having a clanger support mounted on its shaft, the clangers being loosely mounted on the clanger support so that they can strike the bell without impeding the rotation of the motor.

7 Claims, 9 Drawing Figures

BURGLAR ALARM

BACKGROUND OF THE INVENTION

The present invention relates to a burglar alarm, and in particular to a portable and easily installed burglar alarm unit which is reliable and yet can be manufactured inexpensively. The burglar alarm is mounted on one surface and is attached by a chain to a magnet mounted on a movable second surface. A switch assembly activated by a chain when the second surface moves turns on a bell assembly, which continues ringing thereafter regardless of the force on the chain until a button is moved to the "off" position. A bell assembly which is connected in series with a battery and the switch assembly includes a motor which causes clangers to strike against a bell.

Alarms which can detect unauthorized entry are known in the prior art, but such devices are frequently expensive to manufacture and install. Moreover many prior art burglar alarms must be permanently mounted in one installation, and cannot be applied to a variety of tasks such as guarding a hotel room one day and protecting a brief case the next. Furthermore inexpensive portable alarms tend to be limited in both utility and reliability.

Accordingly, one purpose of the present invention is to provide a better burglar alarm.

Another purpose of the present invention is to provide an inexpensive burglar alarm which is reliable and can be adapted to a variety of tasks.

Still another purpose of the present invention is to provide a burglar alarm which, once activated by an unauthorized entry, will emit a continuing ringing sound until it is deactivated regardless of whether the intruder has abandoned his unauthorized entry.

Other objects and purposes of the present invention will become apparent in the description of the preferred embodiment.

DESCRIPTION OF THE PREFERRED EMBODIMENT

Figure 1:
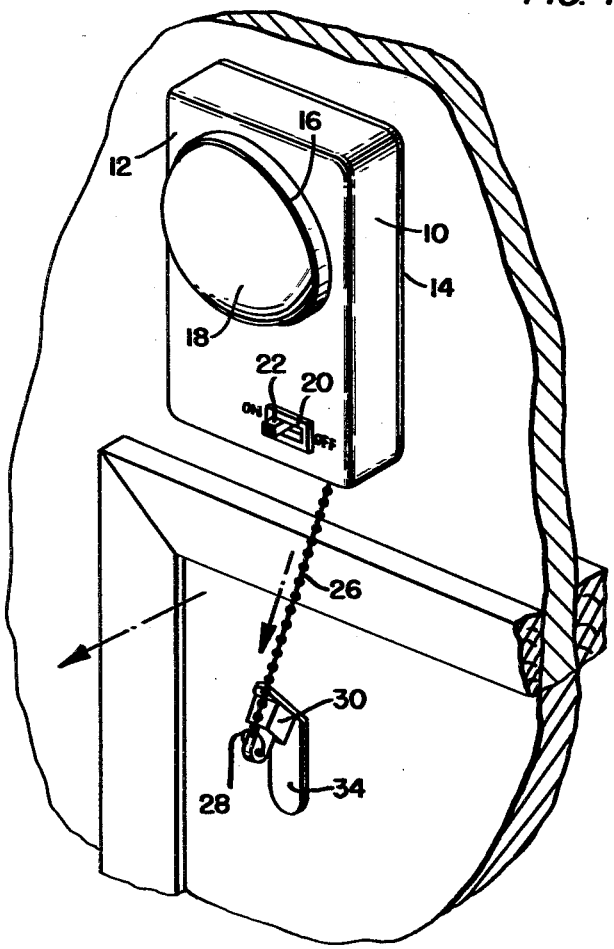
FIG. 1 is a perspective view of the burglar alarm of the present invention mounted to guard against unauthorized entry through a door, illustrating generally the motions of the door and chain when an unauthorized entry occurs.

The burglar alarm of the present invention is illustrated in FIG. 1, and is provided with housing 10 having top cover 12 and bottom cover 14. Top cover 12 has circular aperture 16 through which bell 18 protrudes, rectangular opening 20 through which button 22 protrudes, and an opening (not shown) through which chain 26 extends. It will be apparent that other flexible elongated members, such as cords or plastic strips, could be used in lieu of chain 26. Chain 26 is terminated with ring 28, which is mounted to magnet holder 30. FIG. 1 illustrates housing 10 as being mounted above a door, with magnets (not shown) within holder 30 being magnetically attached to metal bracket 34 which is mounted on a door. It should be apparent, however, that the present invention can be adapted to detect relative motion between a variety of surfaces. For example, housing 10 could be set on the floor and bracket 34 mounted on the door. Alternately, the present invention could be used to sound an alarm upon unwarranted intrusion through a window, unwarranted opening of a brief case, etc. Housing 10 can be mounted to its respective surface by any well-known means, such as screws, nails, or adhesive. Bracket 34 can also be mounted by a variety of methods, although adhesive is preferable.

Figure 5:
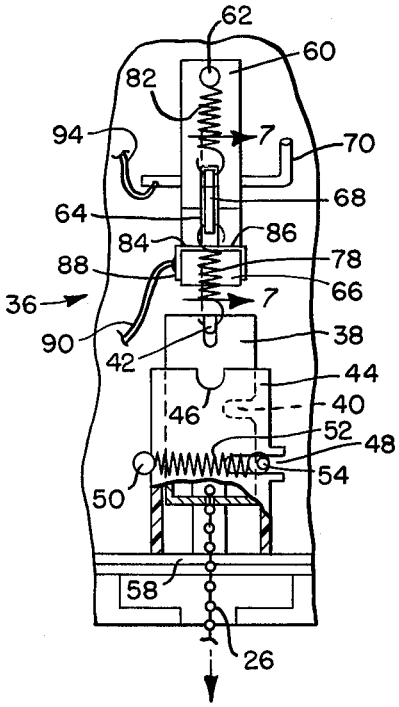
FIG. 5 is a top plan view of the switch assembly in its open position, illustrating generally the motion of the chain leading to the magnet.

Turning now to FIG. 5, switch assembly 36 is illustrated in the "off" position. Plunger 38 of switch assembly 36 is provided with notch 40 and mounting hook 42. Plunger 38 is attached to chain 26 and is movably mounted within encasement 44, which is molded out of the plastic forming bottom case 14. It will be apparent to those skilled in the art that plunger 38 and encagement 44 can have a variety of forms other than the forms illustrated herein; many guide structures which can support a linearly moving member may be employed. Encasement 44 is provided with notch 46, notch 48, and anchor peg 50. Spring 52 extends across encasement 44 from anchor peg 50 to pin 54, which has a terminal L-shaped portion 56 (shown in FIG. 9) which is pivotably mounted in bottom case 14 so as to allow pin 54 to be moved through a small arc. It will be apparent that pulling chain 26 in the direction of the arrow in FIG. 5 will displace plunger 38, moving notch 40 toward pin 54. When plunger 38 abuts flange 58 of bottom case 14 and hook 42 is within notch 46, pin 54 will engage slot 40 and will be urged into slot 48 by the force of spring 52. This is illustrated in FIG. 6.

Figure 7:
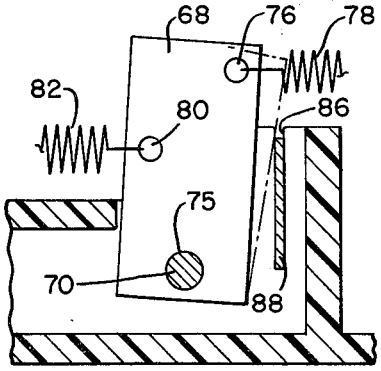
FIG. 7 is a sectional view of the switch assembly taken along the line 7—7 in FIG. 5.

With continuing reference to FIG. 5, platform 60 is molded into the plastic of bottom case 14 and is provided with anchor peg 62, slot 64, and step 66. With reference to FIGS. 5 and 7, metalic contact 68 is pivotably mounted within slot 64 by metalic pin 70, which extends through holes (not shown) in platform 60 and hole 76 in contact 68. Contact 68 is provided with hole 76 for mounting spring 78, which extends to mounting hook 42, and hole 80 for mounting spring 82, which extends to anchor peg 62. It will be apparent that springs 82 and 78, joined through contact 68, provide a force to keep plunger 38 fully withdrawn into encasement 44 unless a force is exerted on chain 26 or unless pin 54 is engaged in slots 40 and 48. That is to say, a slight tug on chain 26 will displace plunger 38 from its at rest position only momentarily, but when chain 26 is pulled with sufficient force to bring slots 40 and 48 into conjunction spring 52 will draw pin 54 into the opening provided by these slots and thereby lock plunger 38 agains the restoring force of springs 78 and 82, even if the tension in chain 26 is relieved, until pin 54 is manually removed from slots 40 and 54. It is apparent that this assembly of elements establishes a threshold force (and corresponding threshold displacement of plunger 38) below which the burglar alarm of the present invention will not respond. If the force on chain 26 exceeds that threshold, however, plunger 38 will be retained in its fully extended position even after the force on chain 26 disappears. One way of setting the threshold level is by a suitable selection os spring 78 and 82, although additional ways will be readily apparent to those skilled in the art.

Figure 2:
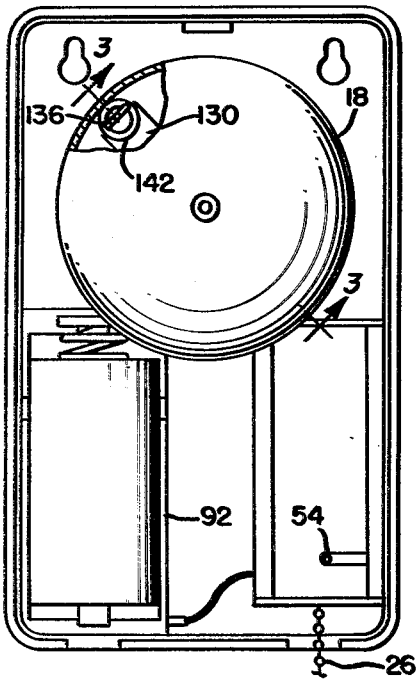
FIG. 2 is a top plan view of the burglar alarm of the present invention with the top case and a portion of the bell removed to show a clanger striking the bell.
Figure 4:
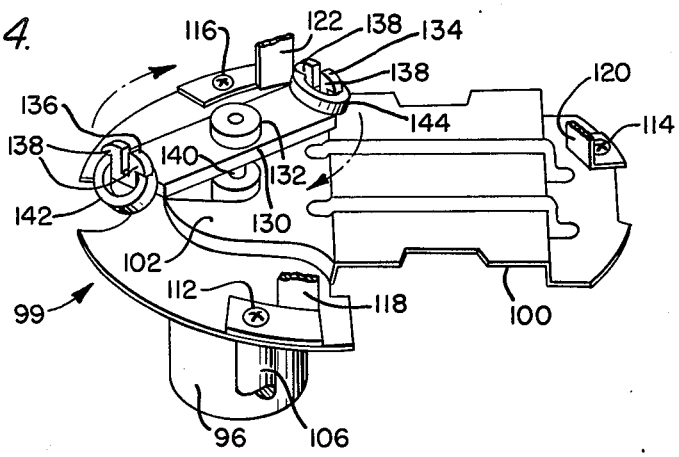
FIG. 4 is a perspective view of the bell assembly with the bell removed, illustrating generally the rotation of the clanger support arm.
Figure 8:
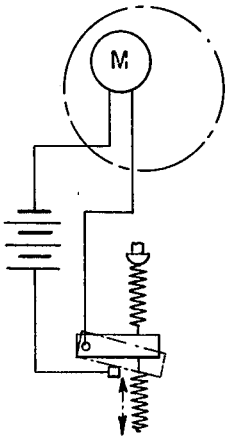
FIG. 8 is a circuit diagram showing the bell assembly and switch assembly in series with a battery.

With continuing reference to FIGS. 5 and 7, step 66 has slots 84 and 86 into which contact 88 is fitted. One end of wire 90 is soldered to contact 88, while the other end leads to the postive terminal of battery compartment 92, as is illustrated in FIG. 2. One end of wire 94 is soldered to pin 70, and the other end is attached to one terminal of motor 96, which is illustrated in FIG. 4. The other terminal of motor 96 is attached to a wire (not shown), which leads to the negative terminal of battery compartment 92. The resulting circuit is illustrated in FIG. 8.

Figure 6:
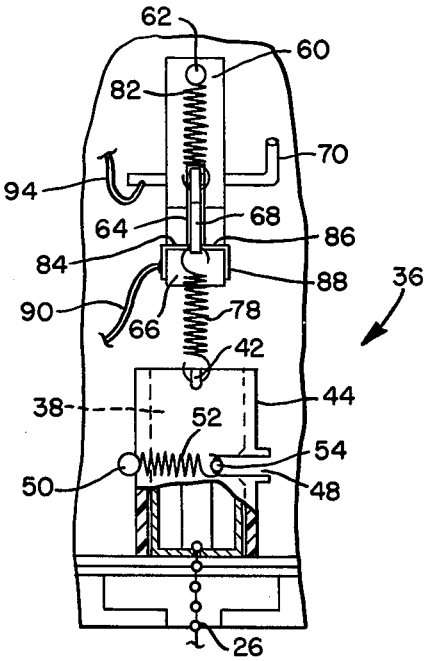
FIG. 6 is a top plan view of the switch assembly in its closed position.

With reference to FIGS. 5, 6, and 7, it will be apparent to those skilled in the art that motor 96 is controlled by whether contacts 68 and 88 in switch assembly 36 are touching. When plunger 38 is at its at rest position, spring 82 urges contact 68 away from contact 88 so that the circuit illustrated in FIG. 8 is open. However, when a force on chain 26 displaces plunger 38 enough to allow pin 54 to move into slots 40 and 48, contact 68 pivots on pin 70 and touches contact 88, thereby completing the circuit and energizing motor 96. Switch assembly 36 is illustrated in the open position in FIG. 5 and in the solid line portion of FIG. 7. Switch assembly 36 is illustrated in the closed position in FIG. 6 and in the dotted line illustration of contact 68 in FIG. 7.

Figure 3:
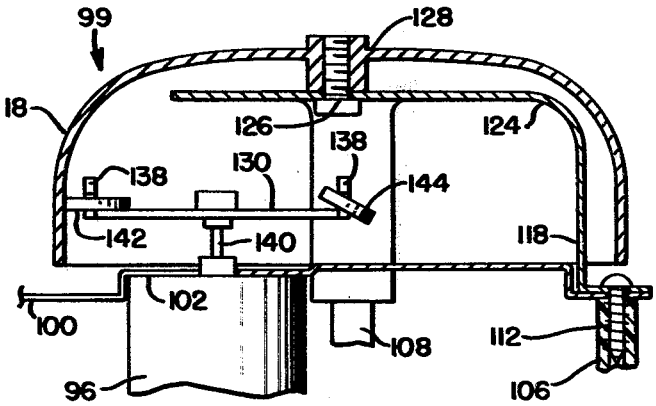
FIG. 3 is a section view taken along the line 3—3 of FIG. 2, illustrating the construction of the bell assembly.

Turning now to FIG. 4, bell assembly 99 will now be described. Sub-chassis 100 is provided with depression 102 which accommodates the front portion of motor 96. A support (not shown) is molded into the plastic of bottom cover 14 and accommodates the rear portion of motor 96. Pillars (not shown) are also molded into the plastic of bottom cover 14, and extend upward around motor 96. Screws 112, 114, and 116 extend through holes in sub-chassis 100 into pillars 106, 108, and 110, securely clamping motor 96 between support 104 and depression 102 of sub-chassis 100. Screws 112, 114, and 116 also mount legs 118, 120, and 122, which are provided by bell support 124, a portion of which is illustrated in FIG. 3.

Screw 126 extends into threaded projection 128 provided by bell 18 so as to firmly mount bell 18 to bell support 124.

Returning to FIG. 4, clanger support arm 130 is provided with mounting hole 132 and slotted projections 134 and 136. Slotted projections 134 and 136 are in turn provided with retaining projections 138. Clanger support arm 130 is mounted by force-fitting shaft 140 of motor 96 into hole 132. Cylindrical brass clangers 142 and 144 are loosely mounted on slotted supports 136 and 134, and kept there by retaining projections 138. As is illustrated in FIG. 3, one of the clangers 142 or 144 will strike bell 18 every half rotation of motor 96. Spacing is adjusted so that clangers 142 and 144 strike bell 18 with glancing blows. It will be apparent that clangers 142 and 144, being loosely mounted, can both rotate and move laterally a small distance when they come into contact with bell 18, so that rotation of motor 96 is not appreciably impeded. The construction allows bell assembly 99 to produce a piercing sound when motor 96 is rotated.

Figure 9:
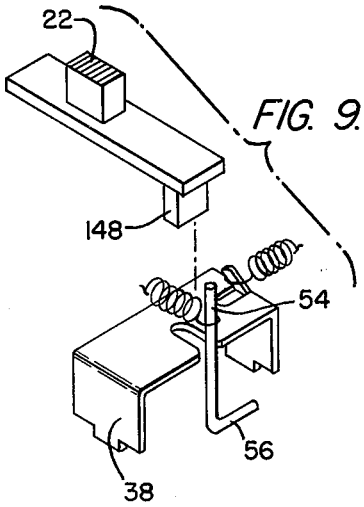
FIG. 9 is an exploded perspective view illustrating the cooperation of elements for activating and deactivating the burglar alarm of the present invention.

Turning now to FIG. 9, button 22 is slidably mounted to top cover 12 by a mounting bracket (not shown), with tooth 148 provided by button 22 extending into the interior of housing 10. Tooth 148 is positioned to one side of pin 54, as is illustrated in FIG. 9. It will be apparent that, when button 22 is in the "on" position illustrated in FIG. 1, pin 54 will be urged into slots 40 and 48 by spring 52 if the forces on chain 26 exceeds the threshold level. Bell assembly 99 will ring until button 22 is placed in the "off" position, which removes pin 54 from slots 40 and 48 and thereby allows plunger 38 to return to its at rest position if there is no force on chain 26. If button 22 is in the "off" position when a force is applied to chain 26, tooth 148 will prevent pin 54 from entering slots 40 and 48.

The overall operation of the burglar alarm of the present invention can now be described. Assume that the device is mounted as illustrated in FIG. 1, with button 22 set to "on", and an unauthorized entry occurss. The door will open and chain 26 will become taunt. When the door opens further chain 26 will activate switch assembly 36 prior to pulling magnet holder 30 away from bracket 34. The fact that magnet holder 30 becomes detached from bracket 34 after switch assembly 36 has been activated prevents damage to the burglar alarm. When switch assembly 36 is activated by an unauthorized entry pin 54 is forced into slots 40 and 48, so that bell assembly 99 continues to ring dispite the fact that chain 26 is no longer being tugged. Bell assembly 99 keeps ringing until button 22 is placed in the "off" position.

When authorized entries are expected magnet holder 30 can simply be left dangling, without being attached to bracket 34. Alternately it may be attached to bell 18, or otherwise kept out of the way. As an added precaution against accidental activation of switch assembly 36, button 22 can be set in the "off" position.

I claim:

1. A burglar alarm for signaling relative motion between a first surface and a second surface, comprising:

a housing attachable to said first surface;

a magnet;

a flexible elongated member having first and second ends, said first end being attached to said magnet;

a switch assembly mounted within said housing, said switch assembly comprising a fixed first contact having first and second side, a second contact pivotably mounted adjacent to the first side of said first contact, a linearly movable element positioned adjacent to the second side of said first contact and linearly movable therefrom, said linearly movable element having a side with a slot therein, the second end of said flexible elongated member being attached to said linearly movable element, and first means cooperating with said linearly movable element for moving said second contact into electrical contact with said first contact and keeping said second contact in electrical contact with said first contact when said linearly movable element has been displaced a predetermined threshold distance, said first means inclusing a pin pivotably mounted adjacent to the side of said linearly movable element having said slot therein and spring means for urging said pin toward the side of said linearly movable element having said slot therein, said pin moving into said slot when said linearly movable element has been displaced said predetermined distance;

second means connected to said switch assembly for producing a continuing sound when said first contact is in electrical contact with said second contact; and manually operated means movable between "on" and "off" positions and cooperating with said pin for moving said second contact out of electrical contact with said first contact when said linearly movable element is not displaced and said manually operated means is moved to "off" position.

2. The burglar alarm of claim 1, wherein said first means further comprising means operationally connecting said linearly movable element and said second contact for urging said second contact toward said first contact.

3. The burglar alarm of claim 1, wherein said first means further comprises a spring extending between said linearly movable element and said second contact.

4. The burglar alarm of claim 3, wherein said first means further comprises means connected to said second contact for urging said second contact away from said first contact.

5. The burglar alarm of claim 4, further comprising a metal bracket and means for mounting said metal bracket on said second surface.

6. The burglar alarm of claim 5, wherein said second means comprises an electric motor having a shaft, a bell, a plurality of clangers, and means mounting said plurality of clangers on said shaft of said motor for striking said clangers against said bell.

7. The burglar alarm of claim 6, wherein said flexible elongated member is a chain.

* * * * *